United States Patent [19]

Moore

[11] Patent Number: 4,749,606

[45] Date of Patent: Jun. 7, 1988

[54] FLOATABLE PAD

[75] Inventor: Richard D. Moore, Auburn, N.H.

[73] Assignee: Plastic Techniques, Inc., Goffstown, N.H.

[21] Appl. No.: 940,577

[22] Filed: Dec. 12, 1986

Related U.S. Application Data

[63] Continuation-in-part of Ser. No. 795,322, Nov. 21, 1985, abandoned.

[51] Int. Cl.[4] ..... B32B 1/04; B32B 3/02; E04H 3/19

[52] U.S. Cl. ..... 428/166; 4/498; 126/415; 428/33; 428/52; 428/80; 428/178

[58] Field of Search ..... 4/497, 498, 499, 502, 4/503, DIG. 1; 220/216, 217, 218, 902; 428/52, 33, 166, 178, 179, 188, 119, 120, 80; 126/415, 416

[56] References Cited

U.S. PATENT DOCUMENTS

| | | | |
|---|---|---|---|
| 3,072,920 | 1/1963 | Yellott | 4/498 |
| 3,405,410 | 10/1968 | Oldshue | 4/498 |
| 3,462,040 | 8/1969 | Galloway | 220/218 |
| 3,683,428 | 8/1972 | Morris | 4/498 |
| 3,872,522 | 3/1975 | Bennett et al. | 4/498 |
| 3,874,987 | 4/1975 | Young | 428/319.7 |
| 3,927,427 | 12/1975 | Aine | 4/499 |
| 3,998,204 | 12/1976 | Fuchs et al. | 4/498 |
| 4,028,750 | 6/1977 | Gustafsson | 4/498 |
| 4,137,575 | 2/1979 | Klaffke et al. | 4/498 |
| 4,139,117 | 2/1979 | Dial | 4/499 |
| 4,166,146 | 8/1979 | Köos | 428/305.5 |
| 4,213,280 | 7/1980 | Sandborn | 220/218 |
| 4,366,806 | 1/1983 | Acker | 4/498 |
| 4,429,683 | 2/1984 | Hull | 4/498 |
| 4,577,352 | 3/1986 | Gautheron | 4/498 |
| 4,601,072 | 7/1986 | Aine | 4/498 |
| 4,628,549 | 12/1986 | Lazar | 428/188 |

FOREIGN PATENT DOCUMENTS

| | | | |
|---|---|---|---|
| 13780 | 6/1928 | Australia | 4/498 |

*Primary Examiner*—William J. Van Balen
*Attorney, Agent, or Firm*—R. Gale Rhodes, Jr.

[57] ABSTRACT

The floatable element or pad including a body of floatable material, such as for example a low density polyethylene, or a high density cross-linked polyethylene, and the like, having a horizontal cross-sectional shape, such as hexagonal, enabling a plurality of such floating elements or pads to engage in flat surface-to-surface contact thereby providing a substantially gapless floating insulating cover. In one embodiment, the floatable element or pad includes top and bottom layers, side walls, and a plurality of thru-posts extending between the top and bottom layers and providing structural rigidity thereto, and wherein the top and bottom layers, side walls and thru-posts cooperatively provided a plurality of dead air spaces providing additional insulation between the liquid, slurry, semi-liquid or the like on which an insulating floatable cover comprised of such floatable elements or pad is comprised.

17 Claims, 4 Drawing Sheets

FLOATABLE PAD

CROSS-REFERENCE TO RELATED APPLICATION

This invention is a continuation-in-part application of application Ser. No. 795,322 filed Nov. 21, 1985, abandoned, Richard D. Moore inventor and assigned to the same assignee as the present invention.

BACKGROUND OF THE INVENTION

This invention relates to a new and improved floatable pad a plurality of which are useful for providing a substantially gapless insulating cover for floating on a liquid or slurry at a first temperature and which liquid or slurry is exposed to an atmosphere at a second lower temperature and wherein the floating insulating cover is for preventing heat loss by convection from the surface of the liquid or slurry to the atmosphere, liquid loss by evaporation and heat loss by such evaporation.

Such floatable pad and gapless floatable insulating cover are particularly useful for preventing such heat loss and liquid evaporation from a liquid or slurry contained in a device typically referred to in the ore separation art as a thickener, although, as will also be understood by those skilled in the art, the floatable pad and substantially gapless floatable insulating cover of the present invention are not so restricted in their usefulness and such pad and insulating cover may be used in other applications where heat transfer and liquid evaporation are problems.

Referring again to the aforementioned thickener, and as known to those skilled in the ore separation art, a thickener is for increasing the percentage of solids (ground ore) in a slurry of solids and water and for reclaiming water to be recycled and reused in the ore separation process. A typical prior art thickener 10 is illustrated diagrammatically in FIG. 1, and as may be noted from FIG. 1, such thickener is of generally conical horizontal cross-sectional shape and includes an underwater boom 12, mounted rotatably as indicated, and from which boom depends downwardly a plurality of vertical members 14 to the bottom ends of which are attached a plurality of rakes 16 for promoting movement of the solids toward and through the drains indicated diagrammatically by the arrows 18. Typically the slurry input to the thickener 10 is from the top as indicated by the arrows 20 in FIG. 1, although as is further understood by those skilled in the art in some thickeners the input is from the bottom. The thickener 10, in operation, is intentionally filled to overflowing to cause a portion of the water to overflow into the surrounding trough 22 from which the water exits and is recycled for reuse in the ore separation process. As is further known to those skilled in the art, a typical thickener may be approximately 200′ in diameter although they can be of different diameters depending upon the particular ore separation process involved.

As if further known to those skilled in the art, water used in the ore separation process (e.g. the ore grinding step), is typically ground water, such as water from an underground well, river, or stream, and hence upon such underground water entering the thickener 10 of FIG. 1, such underground water is typically at a temperature of approximately 55° F. Since many mines in the United States are located in the northern states where the winters are cold, and since most ore separation apparatus are located adjacent the mine for efficiency and reduction of cost associated with transferring ore long distances for ore separation, many thickeners are therefore also located in the northern states where the winters are cold. In the winter months, the temperature of the ambient atmosphere can be, for example, −45° F., and hence a temperature differential of approximately 100° can exist between the temperature of the incoming ground water to the thickener 10 and the temperature of the ambient atmosphere. Typically, as is further known to those skilled in the art, the dwell time of the slurry in a thickener is approximately 40 minutes and with the noted approximately 100° temperature differential, the water can experience significant heat loss through heat transfer to the ambient atmosphere by convection. Since, as noted above, water from the thickener is recycled and reused in the ore separation process, if the water exiting the thickener is greatly reduced in temperature toward the ambient, the water must be reheated at unwanted cost or else the efficiency of the ore separation is reduced since, generally, the higher the temperature of the water in the ore separation process, e.g. the grinding step, the greater the efficiency of the ore separation process.

Still further, and as also known to those skilled in the art, the slurry upon leaving the thickener is further processed in various stages where, for example, the solids (e.g. ground iron ore particles) residing in the exiting water is heated as high as 2,750° F. and since the solids are residing in the water, if the temperature of the water is reduced toward the ambient as described above, the solids residing therein will also be reduced in temperature toward the ambient, and hence greater energy will be required to heat the solids from the ambient to the 2,750° F. temperature than would be required were the temperature of the water to be maintained, or at least substantially maintained, at the above-noted 55° F. temperature.

Accordingly, there exists a need in the art, particularly in the ore separation art with regard to thickeners, for an insulating cover for floating on the liquid or slurry residing in the thickener and for preventing heat loss by transfer of heat to the ambient atmosphere through convection.

As also known to those skilled in the art, particularly the floating insulating cover art, floating insulating covers are known and such prior art floating insulating covers typically comprise a plurality of spherical, sometimes hollow, balls used to cover surfaces of a liquid such as the surface of a typical controlled temperature bath as may be used in acid pickling, plating, rinsing, dyeing, anodizing, phosphating, and food processing in tanks containing liquids, slurries or semi-liquids, maintained at elevated temperatures vis-a-vis the ambient atmosphere. Such prior art floating insulating covers are typically referred to in the art as floating ball blankets and are comprised of generally hollow spherical floatable balls, typically made of plastic, which are reputed to help control the temperature by limiting the surface area exposed to the ambient atmosphere thereby limiting liquid loss or heat loss by heat transfer to the ambient atmosphere by convection from the surface of the covered liquid, slurry, or semi-liquid. As is still further known to those skilled in the floating blanket art, the spherical floatable balls of the prior art, due to their spherical configuration, are engageable only in point-to-point contact and hence provide a floating ball blanket having a plurality of gaps between the spherical floatable balls which gaps leave open space for liquid loss by evaporation, heat loss by such evaporation, and heat loss by heat transfer through convection from the surface of the liquid, etc. Generally, such floatable balls of spherical configuration can cover only approximately 90% of the surface of the liquid, slurry, etc., and as is also known to those skilled in the art, such spherical floatable balls typically float sufficiently high that much less than 90% of the liquid, slurry, etc. surface is in contact with the balls and thus surface evaporation and heat transfer by convection are not curtailed sufficiently as is desired.

Still further, as is also known to those skilled in the art, the spherical shape of the typical prior art floatable ball allows it to roll freely as the liquid is agitated, by being moved or disturbed by the wind, and this rolling action produces an effect similar to the rotating ball of a ballpoint pen, namely, the liquid which wets the bottom of the ball surface is rolled upwardly and exposed to the air and readily evaporates or the heat thereof is readily transferred to the atmosphere and lost through convection.

Accordingly, there exists a need in the art for a floatable insulating cover, comprised of a plurality of individual elements, wherein the elements float in surface-to-surface contact covering the greater portion of the liquid, slurry, semi-liquid or the like, and which provides a more efficient insulation between the liquid, slurry, semi-liquid or the like and the ambient atmosphere.

Still further, as is known to those skilled in the art, particularly the ore processing art including the thickener such as thickener 10 of FIG. 1, the thickener must be drained occasionally for repair purposes and hence for efficiency of repair, and it is desirable that the floating pads or elements of the floating insulating cover be sufficiently rigid to permit a repairman to step on the pad or else the floating pads of the floating insulating cover must be removed from a thickener with the resulting attendant unwanted expense and time loss since a thickener as noted above may be approximately 200′ in diameter, a floating element of even 4′ in diameter requires approximately 2,500 floating elements to cover a thickener approximately 200′ in diameter.

Still further, as is known to those skilled in the art, a thickener exposed to the ambient atmosphere can be exposed to winds, at time high winds, which winds have a tendency to disturb, disrupt and thereby interrupt the floating insulating cover by blowing floating elements away or out of their desired position in surface-to-surface contact. Accordingly, there is a need in the floating insulating cover art of floating elements comprising the cover which float sufficiently low in the liquid, slurry, semi-liquid or the like and which are of sufficient weight to prevent the floating elements from being blown away or the floating insulating cover comprised of such elements to be disturbed and interrupted thereby destroying or greatly reducing the insulating value of the floating cover.

Still further, since as noted above for efficiency the floating elements of the floating insulating cover for covering a large area such as the surface of a thickener are desirably, at least in some embodiments, approximately 4′ in diameter, there exists a need for handling such large size floating elements by manual labor.

As noted above, the temperature of the underground water entering the thickener 10 of FIG. 1 is typically at a temperature of approximately 55° F. and in winter months the temperature of the ambient atmosphere or surrounding air can be as low as −45° F., thus a temperature differential of approximately 100° can exist between the temperature of the incoming ground water to the thickener and the temperature of the ambient atmosphere or surrounding air. It has been discovered that, due to this temperature differential, upon a floating insulating cover of a plurality of floating elements covering the liquid, slurry or semi-liquid in a thickener, the lower portion of the floating elements contacting the slurry, etc. tends to expand and the upper portion of the floatable elements contacting the ambient atmosphere or air tends to contract thereby imparting an upwardly bowed, dish-like, or upwardly extending spherical segment configuration, to the floatable elements. This configuration, particularly upon the floating elements being struck by a strong wind, causes the floating elements to slide up on each other forming gaps in the floating cover thereby reducing, and even destroying, the insulating quality of the floating cover thereby permitting unwanted heat and evaporation losses.

Still further, it has been discovered that even where the above-noted temperature differential is not so great and the upwardly bowed configuration of the floating elements is not so pronounced, upon the individual floating elements being of a substantial diameter or transverse width, even a small amount of tilt in a floatable element can cause it to slide up on an adjacent floatable element thereby reducing, and even destroying, the insulating quality of the floating insulating cover.

It has been further found that upon the above-noted upwardly bowed configuration being imparted to the floating elements and coupled with the tendency of the floating elements to tilt particularly when of the noted substantial size, the presence of a strong or powerful wind can cause the floating elements to be blown across the thickener, etc. being covered thereby destroying the insulating quality of the floating cover and even causing loss, damage, or even destruction of the floating elements. Accordingly, there exists a need in the floating insulating cover art for floating element structure for reducing such unwanted tendencies.

As noted above, approximately 2,500 floating elements can be required to cover a thickener of approximately 200′ in diameter, and it has been found to be highly desirable to couple a plurality of floating elements together to facilitate their removal from a large body of slurry, etc. and even their removal from a smaller body of liquid such as a typical backyard swimming pool.

Accordingly, there exists a need in the floating element art for coupling means for cheaply and effectively coupling a plurality of floating elements together comprising a floating insulating cover.

SUMMARY OF THE INVENTION

The object of the present invention is to provide a floatable element a plurality of which comprise a floating substantially gapless insulating cover overcoming the above-noted prior art problems and providing a substantially gapless floating insulating cover for preventing heat loss, evaporation, etc., from the liquid, slurry, semi-liquid or the like.

The present invention overcomes the above-noted prior art problems and also provides increased opportunities for greater application of floating insulating covers comprised of a plurality of new and improved floatable elements or pads of the present invention.

The floatable element or pad of the present invention includes a body of predetermined floatable material, such as for example a low density polyethylene, or a high density cross-linked polyethylene and the like, having a horizontal cross-sectional shape, such as hexagonal, enabling a plurality of such floating elements or pads to engage in flat surface-to-surface contact thereby providing a substantially gapless floating insulating cover. In one embodiment, the floatable element or pad of the present invention includes top and bottom layers, side walls, and a plurality of thru-posts extending between the top and bottom layers and providing structural rigidity thereto, and wherein the top and bottom layers, side walls and thru-posts cooperatively provide a plurality of dead air spaces providing additional insulation between the liquid, slurry, semi-liquid or the like on which an insulating floatable cover comprised of such floatable elements or pad is comprised.

DESCRIPTION OF THE PREFERRED EMBODIMENTS

Figure 1:
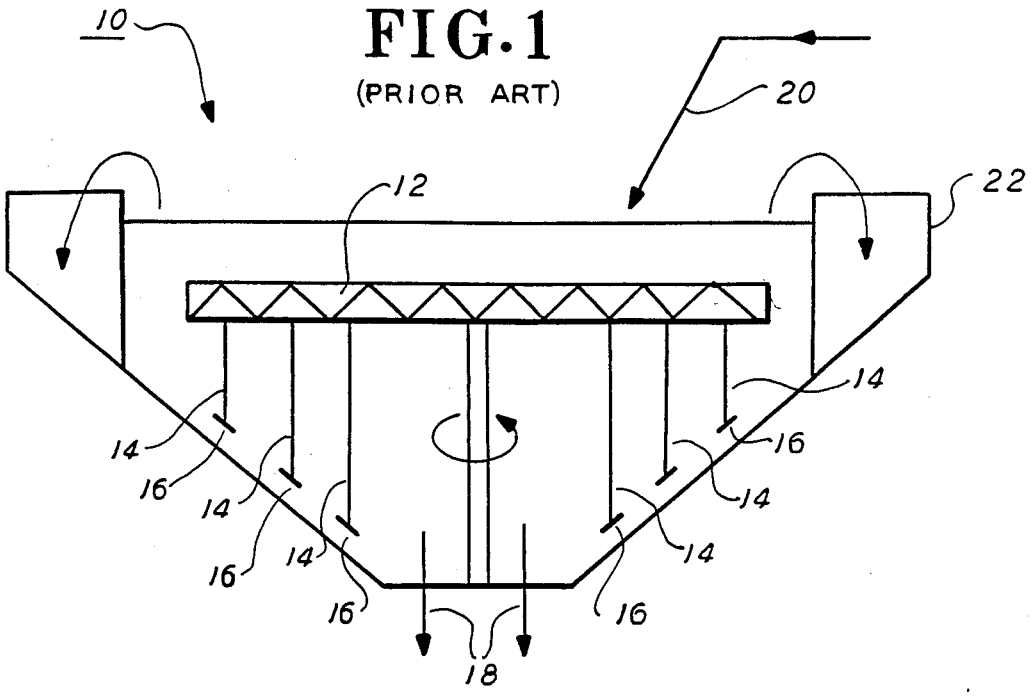
FIG. 1 (PRIOR ART)
FIG. 1 is a diagrammatical view, generally in cross-section, of typical prior art thickener used in a typical prior art ore separation process.
Figure 2:
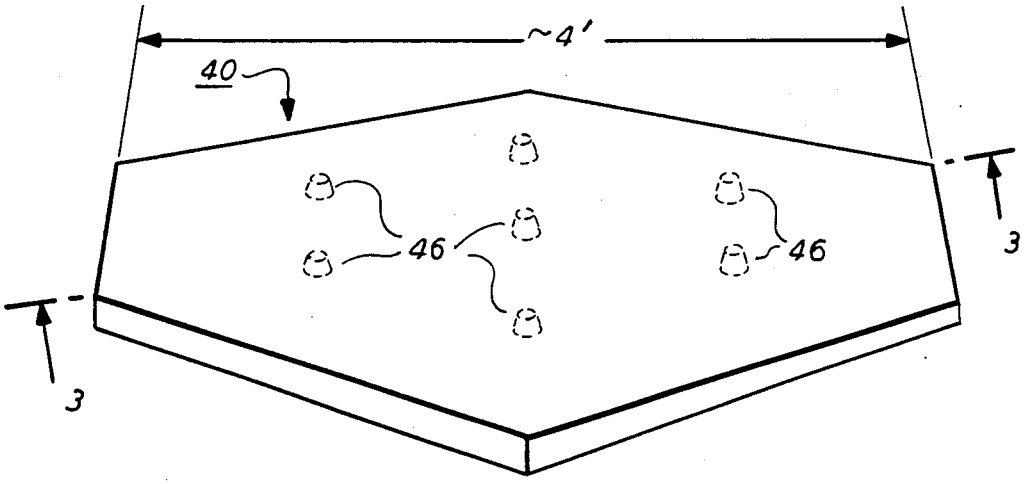
FIG. 2 is a perspective view of a floatable element or pad embodying the present invention and shown in hexagonal configuration.
Figure 10:
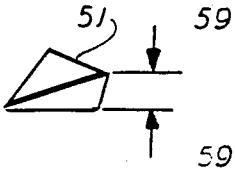
FIG. 10 is an enlarged view of one anti-climbing means of FIG. 9.

Referring now to FIG. 2, there is shown a floatable element or pad embodying the present invention and designated by general numerical designation 40. As may be noted from FIG. 2, the preferred embodiment of the floatable element or pad of the present invention being illustrated therein, in such preferred embodiment the floatable element or pad 40 is of hexagonal horizontal cross-sectional shape thereby providing the surface-to-surface contact between a plurality of such floatable elements or pads 40 illustrated diagrammatically in FIG. 4. As may be noted from FIG. 4, a plurality of floatable elements or pads 40 of the present invention, floating in the surface-to-surface contact illustrated in FIG. 10, provide a substantially gapless insulating cover for floating, for example on the liquid or slurry contained in a thickener such as the thickener 10 of the prior art illustrated diagrammatically in FIG. 1. It will be further noted that such surface-to-surface contact permits a floating insulating cover comprised of a plurality of floatable elements or pads of the present invention to cover substantially all of the surface of a liquid, slurry, semi-liquid or the like unlike the above-noted prior art floating ball blanket which is comprised of a plurality of generally spherical floating balls. As will be understood by reference to FIG. 3, the floatable element or pad 40 of the present invention may nclude top and bottom layers 42 and 44, side walls 45, a plurality of thru-posts 46 (also shown in phantom in FIG. 2) extending between and providing structural rigidity to the top and bottom layers whereby, for example, upon the diameter, or maximum transverse cross-sectional dimension of the floatable pad 40 being approximately 4' as illustrated in FIG. 1, and upon the floatable pad being made of, for example, low density polyethylene, high density cross-linked polyethylene, of suitable commercially available such polyethylenes, or the like, the floating element or pad 40 of the present invention is made sufficiently rigid by such thru-posts 46 as to permit a repairman to step on the floatable element or pad 40 during repair, for example, of the thickener 10 of FIG. 1 without damage to the floatable element or pad 40.

Figure 3:
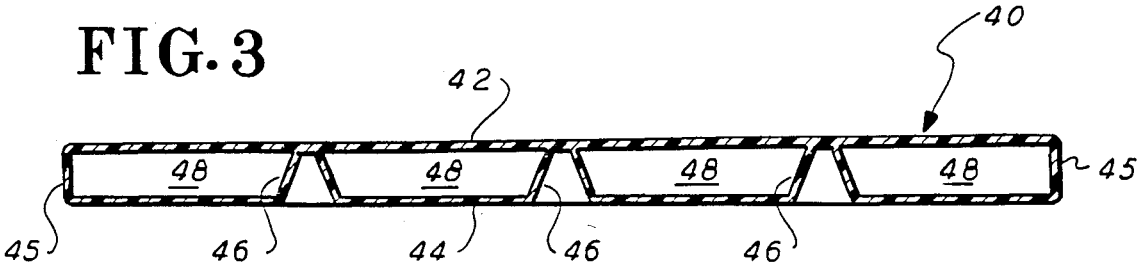
FIG. 3 is a cross-sectional view taken substantially along the line 3—3 in FIG. 2 in the direction of the arrows.
Figure 4:
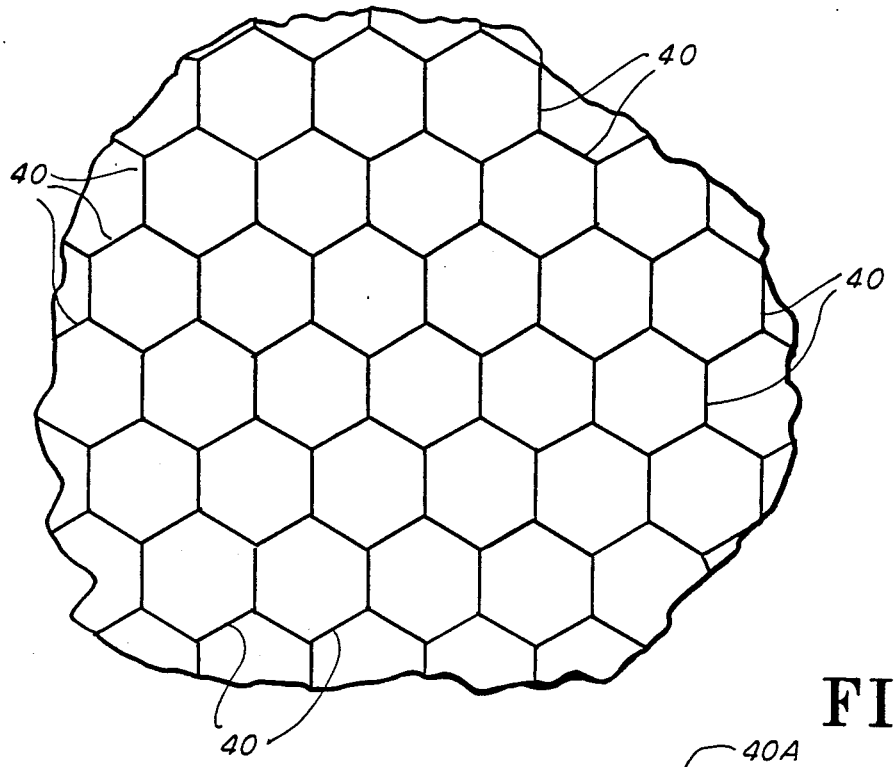
FIG. 4 is a diagrammatical illustration of a substantially gapless floatable insulating cover comprised of a plurality of floatable elements or pads of the present invention and illustrating the surface-to-surface engagement of such elements or pads.

A plurality of dead air spaces 48, as indicated in FIG. 3, are provided cooperatively by the top and bottom layers 42 and 44, side walls 45, and thru-posts 46 and, as will be understood by those skilled in the art, such dead air spaces 48 provide additional insulation to that provided by the floatable element or pad 40 itself, between a liquid, slurry, semi-liquid or the like and the ambient atmosphere.

Figure 5:
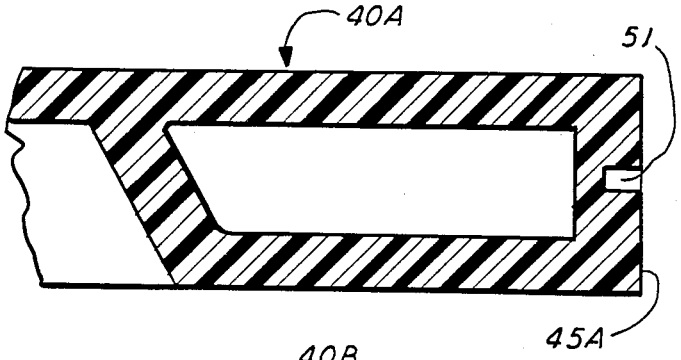
FIG. 5 is a partial cross-section of an alternate embodiment of a floatable element or pad of the present invention illustrating a handle which may be provided to facilitate manual handling of the floatable elements or pads of the present invention.

As illustrated in FIG. 5, an alternate embodiment 40A of the floatable element or pad embodying the present invention may be provided with an inwardly extending groove or slot 51 extending inwardly through a side wall 45A and such inwardly extending slot or groove 51 provides a handle facilitating manual handling of the floatable element or pad 40A. The handle 51 may be provided in each side wall 45A or only in predetermined ones thereof.

Figure 6:
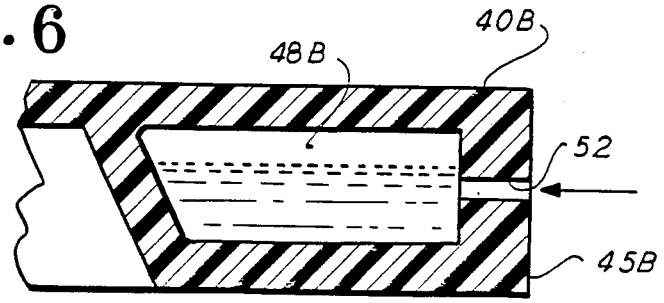
FIG. 6 is a partial cross-sectional view of a further alternate embodiment of the floatable element or pad of the present invention and illustrating, diagrammatically, the manner in which a portion of the liquid, slurry, semi-liquid or the like on which the floatable element or pad floats may be permitted to enter and at least partially fill a dead air space within the floatable element or pad thereby providing additional weight facilitating prevention of the floatable element or pad of the present invention from being blown away by the wind.

As shown in FIG. 6, a further alternate embodiment 40B of a floatable element or pad embodying the present invention may be provided with a hole 52 extending through a sidewall 45B and communicating the interior of the floatable element or pad 40B, and particularly the dead air space 48B, with the exterior of the pad 40B. Such hole 52 permits a portion of the liquid, slurry, semi-liquid or the like on which the floatable element or pad 40B floats to enter and at least partially fill the dead air space 48B thereby providing additional weight to the pad facilitating prevention of the pad 40B from being blown away by the wind or for facilitating prevention of an insulating floatable cover comprised of a plurality of such floatable elements or pads 40B from being disturbed or interrupted with an attendant loss of insulation. Thru-hole 52 may be provided in predetermined ones of the side walls 45B and, if desired and in accordance with the further teachings of the present invention, each side wall, or predetermined ones thereof, may be provided with both the handle 51 of FIG. 5 and the hole 52 of FIG. 6 or any combination thereof.

Further alternatively, and in accordance with the further teachings of the present invention, the dead air spaces 48, FIG. 3, may be filled with additional insulating material, providing further insulation, such as for example closed cell foam chosen from any one of commercially available closed cell foams known to the art, which closed cell foam will provide increased insulation between a liquid, slurry, semi-liquid or the like and the ambient atmosphere.

As is still further known to those skilled in the art, particularly the ore separation art including a thickener such as thickener 10 of FIG. 1, upon the temperature of the liquid or slurry in the thickener 10 being greater, or substantially greater, than the temperature of the ambient atmosphere, such liquid or slurry radiates heat and, in accordance with the further teachings of the present invention, upon the floatable element or pad 40 of the present invention being made of moldable material, such as the above-noted polyethylenes, it has been discovered that by providing such moldable material with heat reflecting particles, such as glitter, particles of various metals, and the like, such heat reflecting materials will form on the inside surfaces of the floatable element or pad 40, particularly upon such pad being molded for example from the noted polyethylenes by rotational molding, and hence such heat reflecting particles will reflect heat radiating from such liquid or slurry back thereto and further prevent heat transfer from the liquid or slurry to the ambient atmosphere with the unwanted attendant heat loss of the liquid or slurry.

Figure 7:
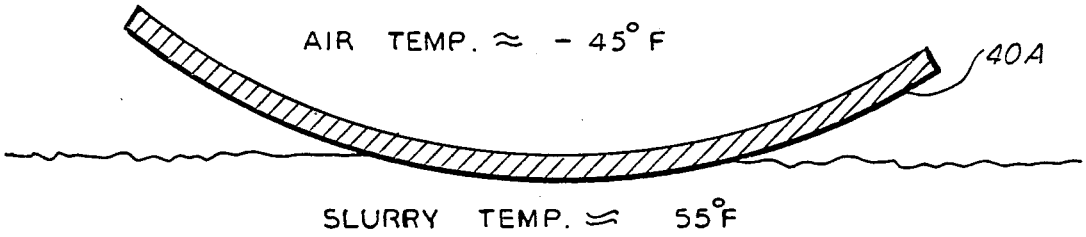
FIG. 7 is a diagrammatical illustration, partially in cross-section, illustrating the temperature differential problem which causes a floating element to assume a dish-like configuration.

Referring now to FIG. 7, there is illustrated diagrammatically the situation noted above wherein the lower portion of a floating element, e.g. floatable pad 40A, contacts a slurry, etc., at a temperature of approximately 55° F. while the upper portion of the floating element or floatable pad 40A contacts the ambient atmosphere or air at a temperature of approximately −45° F. causing the floatable pad 40A to be subjected to a temperature differential of approximately 100°. This temperature differential, as illustrated diagrammatically in FIG. 7, causes the upper portion of the floatable pad 40A to shrink or contract and the lower portion of the floatable pad 40A to expand thereby providing the floatable pad 40A with the upwardly extending dish-like configuration shown. This configuration causes the floatable pad to tend to slide upon an adjacent floatable pad particularly upon the upwardly-dished floatable pad experiencing a strong wind; the strong wind can also cause the upwardly-dished floatable pad 40A to be blown away, damaged or even lost.

Figure 8:
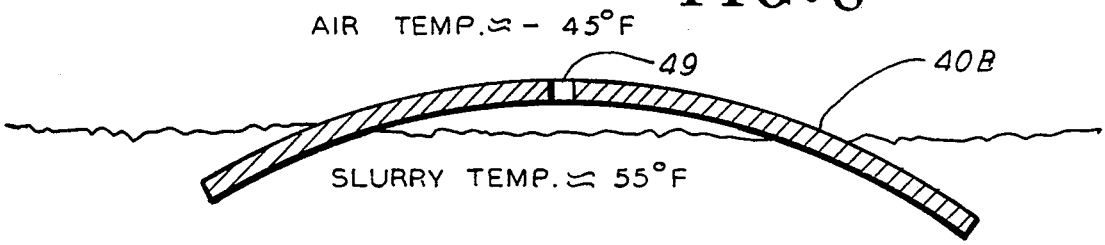
FIG. 8 is a diagrammatical illustration, partially in cross-section, illustrating a further embodiment of the present invention provided with a dome-like spherical configuration for overcoming the temperature differential problem.

It has been discovered, and in accordance with the further teachings of the present invention, that this upwardly-dished tendency can be overcome by providing the floatable pad with the dome-like spherical segment configuration of the embodiment of the present invention illustrated diagrammatically in FIG. 8 and identified by numerical designation 40B. It will be understood that the expression "dome-like spherical segment" is used herein and in the appended claims to connote that upon the floatable pad 40B being placed upon the liquid or slurry in its intended use it is not dish-shaped, i.e. it is not curved upwardly with respect to the liquid or slurry but instead is curved outwardly with respect to the liquid or slurry in the nature of a dome as shown in FIG. 8. Referring again to FIG. 8, it will be understood that in accordance with the further teachings of the present invention the outwardly curved or dome-like spherical segment configuration floatable pad 40B may be provided with a suitable vent hole 49 for preventing or venting air bubble formation underneath the floatable pad 40B upon being placed on a slurry or other liquid or semi-liquid. It has been discovered that by imparting such dome-like spherical segment configuration to the floatable pad 40B upon the lower portion engaging the slurry, for example at a temperature of approximately 55° F. and upon the upper portion of the floatable pad 40B engaging the ambient atmosphere or air at a temperature of approximately −45° F., the lower portion of the floatable pad 40B will tend to expand and the upper portion will tend to contract thereby tending to cause, or causing, the floatable pad 40B to assume a flat shape or configuration thereby reducing the tendency to form gaps noted above. It will be understood by those skilled in the art that upon an understanding of the benefit of this dome-like spherical segment configuration of a floatable pad, more or less dome-like configuration may be imparted to the floatable pad in accordance with the teachings of the present invention, upon a determination of the temperature differential to be encountered, or at least the average temperature differential to be encountered, upon the floatable pad being placed in its intended use.

Figure 9:
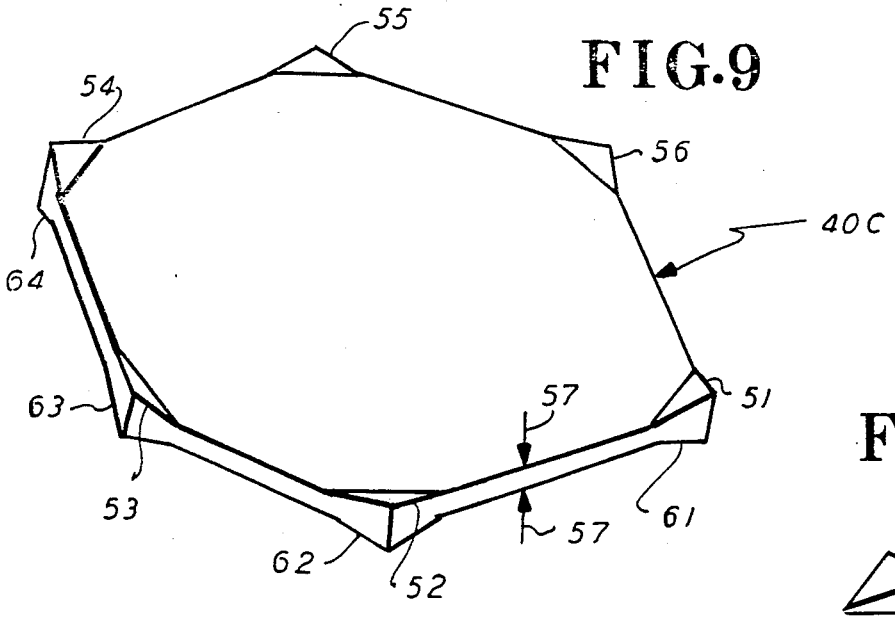
FIG. 9 is a top view, in perspective, of a further embodiment of a floating element in accordance with the teachings of the present invention provided with anti-climbing means.

Referring now to FIGS. 9 and 10, there is illustrated a still further embodiment of a floatable pad of the present invention identified by general numerical designatin 40C and provided with anti-climbing means for preventing the floatable pad, upon being tilted upwardly, from climbing upon an adjacent floatable pad. The anti-climbing means comprise a plurality of upwardly and downwardly extending protrusions indicated by numerical designations 51 . . . 56 and 61 . . . 66, respectively; downwardly extending protrusions 65 and 66 not being shown. As may be better understood by reference to FIG. 10 and illustrative upwardly extending protrusion 51, the upwardly and downwardly extending protrusions are of a general tetrahedron shape.

It will be further understood that the floatable pad 40C has a predetermined thickness indicated by arrows 57-57 and that in accordance wit the further teachings of the present invention the upwardly and downwardly extending protrusions may advantageously have a height, indicated by arrows 59-59, equal to at least one-half of the thickness of the body of the floatable pad C. In one embodiment of this invention, the floatable pad 40C had a thickness of 1¾" and the upwardly and downwardly extending protrusions had a height of 1¼". It has been found that these upwardly and downwardly extending protrusions substantially eliminate climbing, and sliding over, of adjacent floatable pads and substantially precludes gaps forming in a floatable insulating cover comprised of floatable pads 40C and thereby substantially reduces the above-noted heat and evaporation losses. It will be further understood, and as illustrated in FIG. 9, and in accordance with the preferred embodiment of floatable pad 40C, the upwardly and downwardly extending protrusions are provided at the corners of the hexagonally shaped floatable pad 40C.

Figure 11:
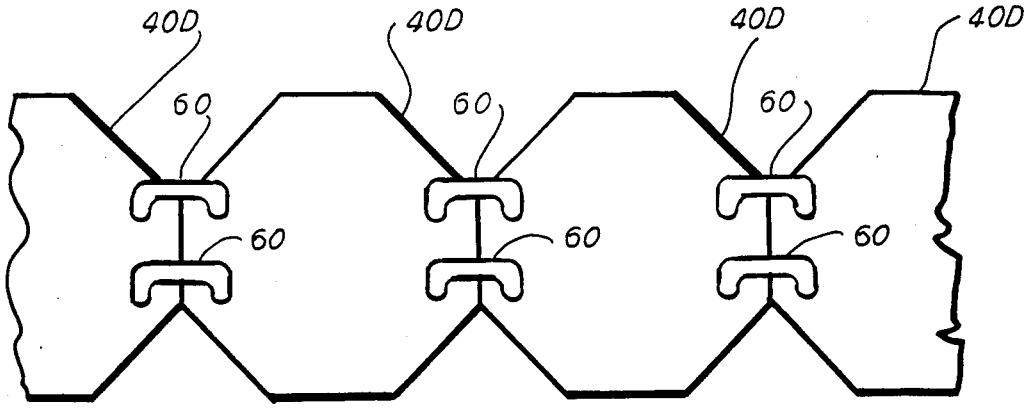
FIG. 11 is a top partial view of a plurality of floating elements of a still further embodiment of the present invention provided with coupling means to facilitate removal of a plurality of floating elements from a slurry, etc.
Figure 12:
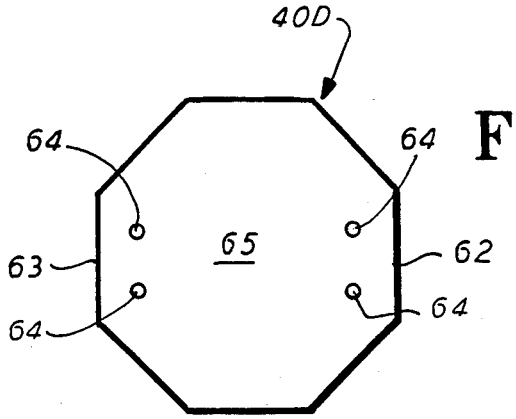
FIG. 12 is a top view of one of the floating element embodiments of FIG. 11.
Figure 13:
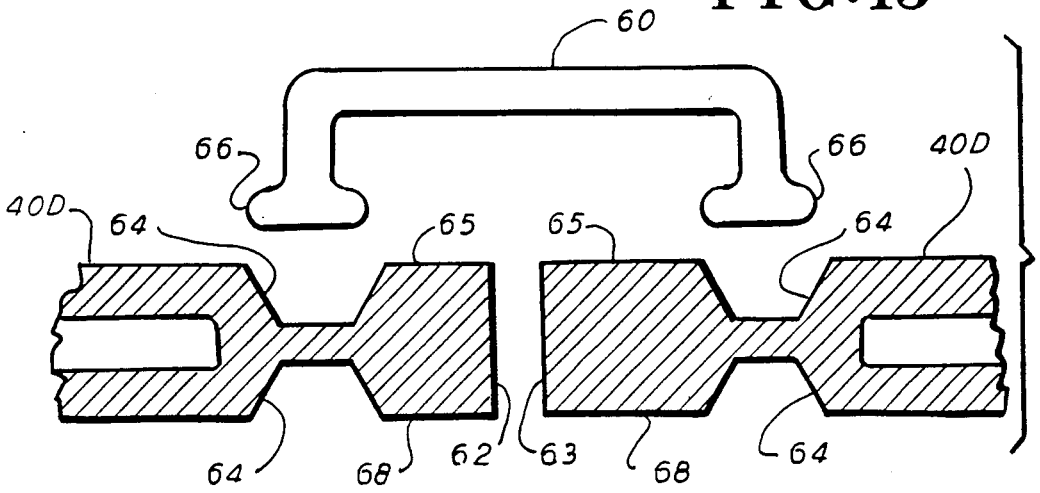
FIG. 13 is a partial view, in cross-section, of the detailed structure of the coupling means shown generally in FIG. 11.

A still further embodiment of the floatable pad embodying the present invention is illustrated in FIGS. 11–13 and identified by general numerical designation 40D. In this embodiment, it will be understood generally that the floatable pads are provided with coupling means for coupling a plurality of the pads together to facilitate removal from a slurry, liquid or semi-liquid of the types described above; this coupling is illustrated diagrammatically in FIG. 11 by the couplers 60 which couple the floating pads 40D together facilitating their removal. As may be better understood from FIGS. 12 and 13, and referring first to FIG. 12, it will be understood that in the embodiment of the floatable pad 40D illustrated the floatable pad includes opposed edges 62 and 63 and is provided with inwardly tapered holes 64 adjacent edges 62 and 63; holes 64 extend inwardly substantially perpendicular to the top and bottom surfaces 65 and 68, respectively; note FIG. 13. The holes 64, as may be noted further from FIG. 13, are for receiving the outwardly extending lower portions 66 of the generally U-shaped coupler 60 to couple adjacent floatable pads 40D-40D to facilitate their noted removal. For reversibility, as may be understood by reference to FIG. 13, the inwardly tapered holes 64 may be provided in opposed relationship to enhance the reversibility of the floatable pads 40D.

It will be further understood that it is within the teachings of the present invention to provide the floatable pad 40B of FIG. 8 with either, or both, the anti-climbing means illustrated in FIG. 9 and the coupling means illustrated in FIGS. 11–13. Also, it will be understood that the floatable pad 40C of FIG. 9 may be combined with the coupling means of FIGS. 11–13. Still further, it will be understood that floatable pad 40B of FIG. 8, floatable pad 40C of FIG. 9, and floatable pad 40D of FIGS. 11–13, may be provided with the floatable pad structures of FIGS. 3, 5 and 6.

While in the preferred embodiment of the floatable pad or element of the present invention the horizontal cross-sectional shape is hexagonal to provide the noted surface-to-surface contact, it will be understood that the present invention is not so limited and that the horizontal cross-sectional shape may be octagonal or the like.

As understood by those skilled in the art, the foregoing teachings and illustrations are merely illustrative of the present invention and many variations and modifications may be made without departing from the spirit and the scope thereof.

What is claimed is:

1. A floatable pad a plurality of which are useful for providing a substantially gapless insulating cover for floating on a liquid or slurry at a first temperature and which liquid or slurry is exposed to an atmosphere at a second lower temperature, comprising:

a body of predetermined floatable material, and said material of predetermined horizontal cross-sectional shape enabling a plurality of said pads to engage in flat surface-to-surface contact to provide said substantially gapless insulating cover; and said body including horizontal top and bottom layers, vertical side walls, and a plurality of thru-posts extending vertically between and providing structural rigidity to said top and bottom layers, said top and bottom layers, said side walls and said thru-posts cooperatively providing a plurality of dead air spaces providing additional insulation between said liquid or slurry and said atmosphere.

2. A floatable pad according to claim 1 wherein said predetermined horizontal cross-sectional shape is hexagonal.

3. A floatable pad according to claim 1 wherein said predetermined material is low density polyethylene, wherein said predetermined horizontal cross-sectional shape is hexagonal, and wherein said top and bottom layers, said side walls and said thru-posts are molded integrally from said polyethylene.

4. A floatable pad according to claim 1 wherein said predetermined material is high density cross-linked polyethylene, wherein said predetermined horizontal cross-sectional shape is hexagonal, and wherein said top and bottom layers, said side walls and said thru-posts are molded integrally from said polyethylene.

5. A floatable pad according to claim 2, or 3 wherein said dead air spaces are filled with predetermined closed cell foam for providing increased insulation between said liquid or slurry and said atmosphere.

6. A floatable pad according to claim 1 or 2 wherein said liquid or slurry radiates heat, wherein said material is predetermined moldable material and wherein said moldable material includes predetermined heat reflecting particles for reflecting heat radiating from said liquid or slurry back thereto.

7. A floatable pad according to claim 1 or 2 wherein upon said insulating cover floating on said liquid or slurry said insulating cover can be exposed to wind, wherein predetermined ones of said side walls are provided with holes extending therethrough communicating the exterior of said pad with predetermined ones of said dead air spaces, said holes permitting a portion of said liquid or slurry to enter predetermined ones of said dead air spaces thereby providing additional weight to said pad facilitating prevention of said pad from being blown away by said wind.

8. A floatable pad according to claim 3 wherein predetermined ones of said side walls are provided with inwardly extending grooves providing handles facilitating manual handling of said pad.

9. A floatable pad according to claim 1 wherein said body of predetermined floatable material is a dome-like spherical segment having spherically upwardly curved upper and lower portions whereby upon said first temperature being substantially higher than said second temperature and upon said lower upwardly curved portion engaging said liquid or slurry and said upper upwardly curved portion engaging said atmosphere, said lower upwardly curved portion expands and said top upwardly curved portion contracts to cause said body of predetermined floatable material to become substantially flat.

10. A floatable pad according to claim 9 wherein said floatable pad of said dome-like spherical segment is provided with at least one vent hole extending therethrough to prevent air bubble formation underneath said floatable pad upon being placed on said liquid or slurry.

11. A floatable pad according to claim 1 or 9 wherein said body of predetermined floatable material is provided with anti-climbing means for preventing one adjacent floatable pad upon being tilted upwardly from climbing upon another adjacent floatable pad.

12. A floatable pad according to claim 11 wherein said anticlimbing means comprise a plurality of upwardly and downwardly extending protrusions.

13. A floatable pad according to claim 12 wherein said body of predetermined floatable material is provided with a plurality of corners and wherein said upwardly and downwardly extending protrusions comprise upwardly and downwardly extending protrusions located at said corners and of a general tetrahedron shape.

14. A floatable pad according to claim 13 wherein said body of predetermined floatable material has a predetermined thickness and wherein said protrusions have a predetermined height substantially equal to at least one half of the thickness of said body of predetermined floatable material.

15. A floatable pad according to claim 1 wherein said pads are provided with coupling means for coupling a plurality of said pads together to facilitate removal thereof from said liquid or slurry.

16. A floatable pad according to claim 1 wherein said body includes a top surface and wherein said predetermined horizontal cross-sectional shape provides said floatable pad with opposed edges and wherein said floatable pad is provided with at least one inwardly tapered hole adjacent each of said opposed edges and extending inwardly substantially perpendicular to said top surface, said inwardly tapered hole for receiving one of the outwardly extending lower portions of a generally U-shaped coupler to couple a plurality of said floatable pads together thereby facilitating removal of said couple floatable pads from said liquid or slurry.

17. In combination at least two floatable pads according to claim 16 and at least one U-shaped coupler.

* * * * *